United States Patent [19]

Kugler et al.

[11] 4,325,330

[45] Apr. 20, 1982

[54] APPARATUS FOR CONTROLLING THE COOLING SYSTEM OF A MOTOR-VEHICLE DRIVE

[75] Inventors: Artur Kugler, Hainhofen/near Augsburg; Franz X. Zaunberger, Augsburg, both of Fed. Rep. of Germany

[73] Assignee: Firma Zahnräderfabrik Renk Aktiengesellschaft, Augsburg, Fed. Rep. of Germany

[21] Appl. No.: 46,041

[22] Filed: Jun. 6, 1979

Related U.S. Application Data

[63] Continuation of Ser. No. 510,740, Sep. 30, 1974, abandoned.

[51] Int. Cl.[3] ..... F01P 7/08

[52] U.S. Cl. ..... 123/41.12; 123/41.13; 62/243; 62/323.4; 192/0.096

[58] Field of Search ..... 123/41.05, 41.11, 41.12, 123/41.13, 41.49; 165/51, 23; 62/230, 243, 323.4; 180/54 A, 132; 192/0.048, 0.076, 0.096, 82 T, 84 R

[56] References Cited

U.S. PATENT DOCUMENTS

| | | | |
|---|---|---|---|
| 2,807,246 | 9/1957 | Jacobs | 123/41.12 |
| 3,651,658 | 3/1972 | Kushida | 62/230 |
| 3,710,587 | 1/1973 | Hayashi | 62/230 |
| 3,724,230 | 4/1973 | Muto et al. | 62/323 |
| 3,813,894 | 6/1974 | Bonnaud | 62/323 |
| 3,844,130 | 10/1974 | Wahnish | 62/323 |

*Primary Examiner*—Charles J. Myhre
*Assistant Examiner*—W. R. Wolfe
*Attorney, Agent, or Firm*—Karl F. Ross

[57] ABSTRACT

A motor-vehicle drive engine has a cooling system to which it is connected via a transmission so that it can drive its own cooling system. A controller responsive to various parameters of the engine, particularly load power requirements, operates the cooling-system transmission through a cutout circuit so as to disconnect the cooling system from the engine when the engine temperature is below a predetermined level so that the full engine output power can be applied to a load. Thus the engine loading, engine output speed, engine heat, accelerator-pedal setting, and/or similar parameters are detected and fed to the controller which automatically cuts the cooling system off for a predetermined fixed interval (controlled by a timer) whenever it is possible for the engine to operate for this interval without the cooling system and the work produced by the engine is otherwise needed. A temperature sensor may reconnect the engine and the fan when the engine temperature rises impermissibly.

4 Claims, 1 Drawing Figure

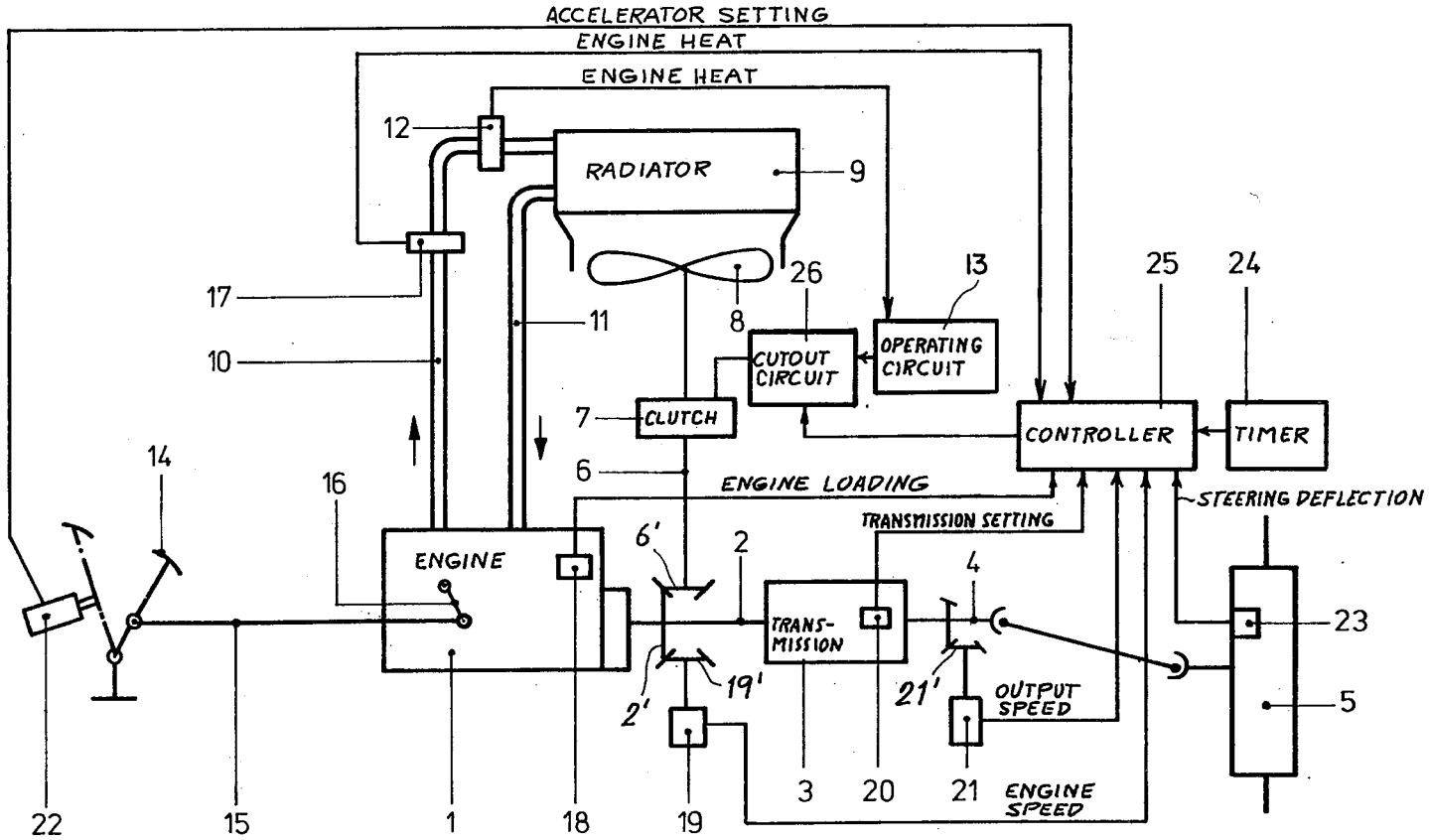
TIMER
CONTROLLER
STEERING DEFLECTION
OPERATING CIRCUIT
CUTOUT CIRCUIT
CLUTCH
RADIATOR
ENGINE
TRANS-MISSION
OUTPUT SPEED
ENGINE SPEED
TRANSMISSION SETTING
ENGINE LOADING
ENGINE HEAT
ACCELERATOR SETTING

APPARATUS FOR CONTROLLING THE COOLING SYSTEM OF A MOTOR-VEHICLE DRIVE

CROSS-REFERENCE TO RELATED APPLICATION

This is a continuation of our application Ser. No. 510,740 filed Sept. 30, 1974 and now abandoned.

FIELD OF THE INVENTION

The present invention relates to an engine (prime mover) system and more particularly, an apparatus for operating the cooling system of a motor-vehicle drive.

BACKGROUND OF THE INVENTION

A motor-vehicle drive is usually provided with a cooling fan which forces a current of air either directly over the engine or through a radiator forming part of the engine-cooling system. Since motor-vehicle engines, usually of the internal-combustion type, are of limited efficiency and produce enormous quantities of heat which must be dissipated, it is necessary that this cooling system have a relatively large capacity. Thus it is not at all uncommon in such engines for the cooling system itself to use between 10 and 20% of the power output of the motor.

It is known to reduce the energy consumption of the cooling system by providing a transmission between the blower and the engine. This transmission is controlled according to the temperature of the motor so that the quantity of air displaced is dependent on the engine-cooling requirements. The arrangement is traditionally connected so that, as the engine temperature increases, the fan speed of the cooling system increases, and therefore the capacity of the cooling system to dissipate this increased heat is augmented.

Such an arrangement limits the loading to which the engine can be subjected. This is particularly true when the engine has been operating for a relatively long period of time and is already quite hot as, in this circumstance, the fan will be driven at full speed practically all the time and will rob the engine of a predetermined proportion of available power whether or not this power could better be used otherwise.

OBJECTS OF THE INVENTION

It is therefore an object of the present invention to provide an improved apparatus for operating a vehicular drive having a cooling system.

Another object of this invention is to provide an apparatus for controlling a motor-vehicle drive which does not disadvanteously limit the amount of useful work which can be performed by the engine.

SUMMARY OF THE INVENTION

These objects are obtained according to the present invention in a system wherein the transmission between the engine and the cooling system is controlled in part by a sensor that detects the power requirement of the load on the engine and completely cuts the cooling system off from the engine when this requirement exceeds a predetermined level. Thus the power which normally would be used to drive the cooling system can be employed to accelerate the vehicle at a greater rate, maintain the same speed on an increasingly steep incline, or, in the case of a full-track vehicle, turn it more sharply.

The system according to the present invention comprises an operator for the transmission which is connected via a controller to a plurality of sensors. These sensors can detect engine heat, engine speed, transmission setting, transmission-output speed, steering deflection, simple engine loading in terms of torque exerted by the engine, accelerator-pedal setting, and other characteristics largely dependent upon the power requirement of the engine load, or determinative thereof.

In accordance with a further feature of this invention the cooling system is only shut down for a limited brief interval when the power requirement exceeds a predetermined level. We further provide means for completely preventing a shutdown of the cooling system if the engine temperature is close to a critical temperature.

The system according to the present invention allows engine output which would normally be employed to drive the cooling system to be used for other purposes as long as the engine is hotter than a predetermined temperature. Thus the acceleration capability with a cold engine is increased considerably as is the power which can be drawn from the engine in spurts when it is running at a cool or moderate heat level.

BRIEF DESCRIPTION OF THE DRAWING

The above and other objects, features, and advantages of our invention will become more readily apparent from the following description, reference being made to the accompanying drawing whose sole FIGURE is a schematic diagram of a system embodying the present invention.

SPECIFIC DESCRIPTION

As shown in FIG. 1, an internal-combustion engine 1 of a motor vehicle has an output shaft 2 connected via a multiple-speed transmission 3 to an output shaft 4. A steering device 5 is connected to shaft 4. A shaft 6 is driven by the primary motor output shaft 2 and is connected to a controllable clutch 7. A blower 8 carried on the other side of this clutch 7 serves to force a current of air through a radiator 9 forming part of a cooling system connected to the engine via an incoming conduit 10 and an outgoing conduit 11.

A thermostat 12 is provided in the conduit 10 of coolant coming from the engine 1 to the radiator 9 and is connected to an operating circuit 13 which in turn is connected via a cutout circuit 26 to the clutch 7 and prevents this clutch 7 from uncoupling the blower 8 from the shaft 6 when the engine temperature as indicated by the coolant temperature exceeds a predetermined critical level. Shaft 6 is driven by a bevel gear 6' from a bevel gear 2' of the power shaft 2.

An accelerator pedal 14 of the motor vehicle is connected via a linkage 15 to the operating arm 16 of the carburetor. Depression of this accelerator pedal 14 advances the carburetor and increases the output speed at the shaft 2 of the engine 1.

Another thermostat 17 in the conduit 10 is connected to a controller 25 and generates an output proportional to engine heat, similar to the thermostat 12. This output is fed to the controller 25 which in turn has an output connected to the cutout circuit 26. Another sensor 18 carried on the engine 1 between this engine and the frame and comprising a strain gauge generates an output directly proportional to engine loading, here equal to the torque exerted by the engine 1 on the motor-vehicle frame. A sensor 19 is directly connected to the output shaft 2 by a bevel gear 19' and generates an output proportional to engine speed which also is fed with the outputs of sensors 17 and 18 to the controller 25.

A sensor 20 is provided on the transmission 3 and feeds a signal to the controller 25 indicating the transmission setting, that is the input/output ratio of the transmission. A sensor 21 identical to the sensor 19 is connected to the transmission output shaft 4 by bevel gearing 21' and generates an output signal indicating actual transmission-output speed, this signal being also fed to the controller 25 as a reference value.

A further sensor or detector 22 is connected to the accelerator pedal 14 and generates an output signal indicating the accelerator setting, which is led to the controller 25. Finally a sensor 23 carried on the steering mechanism 5 indicates the steering deflection or any deflection from a straight course which is called for by the steering wheel.

A timer 24 is connected to the controller 25 so as to limit the amount of time during which the controller 25 connected to the operating circuit 26 can disconnect the fan 8 from the shaft 6.

In operation all the various reference values fed in from the sensors 17–23 are compared in the controller 25 which automatically disconnects the blower 8 from the shaft 6 for the period established by the timer 24 whenever the engine temperature as detected by sensor 17 is below a predetermined level and the power which is being called for from the engine as indicated by sensors 22 and 23 exceeds a predetermined level. The reference-value outputs of sensors 18, 19, 20, and 21 are utilized by the controller 25 to determine whether the power requirements to be made on the engine can be met without disconnecting the fan 8; if they can be so met the fan 8 will be left connected through the coupling 7 to the engine 1.

It is also possible to employ only the components 12, 22, 24, 25, and 26, which can be arranged to work together in such a way that when the gas pedal 14 is fully depressed and the motor output speed is less than 50% of the maximum motor speed the cooling fan 8 is shut off for a 15-second period. This speed, of course, can vary only within a certain range. It is also possible by way of further example to use only the components 17, 18, 20, and 22–26 so that in a full-track vehicle, when a curve is negotiated which has less than a predetermined curve radius, the transmission is set below a predetermined input/output ratio, only a nominal torque is being applied to the engine, and the gas pedal 14 is set below a predetermined level, the fan 8 is arrested for a predetermined time whose duration is dependent on the engine heat capacity and the capacity of the cooling systems 8–11 to dissipate engine heat.

In accordance with the present invention the controller 25 can be arranged to accept different reference values and set points for other parameters of the system, depending on just what kind of load is being handled and what particular outputs have priority. Also the switching device 25 can be set up for other functions and the transmission speed control 13 and the switching circuit 26 can be combined into a single unit.

We claim:

1. In a vehicular drive wherein an internal-combustion engine is provided with cooling means for preventing overheating thereof, control means responsive to full depression of an accelerator pedal for deactivating said cooling means to enhance the power output of the engine, and heat-sensing means for disabling said control means in the presence of engine temperatures exceeding a predetermined limit, the combination therewith of a timer connected to said control means for limiting the deactivation of said cooling means to a predetermined maximum period.

2. The combination defined in claim 1, further comprising speed-sensing means connected to said control means for enabling deactivation of said coupling means only upon the engine speed being less than a predetermined fraction of an upper range limit.

3. The combination defined in claim 2 wherein said predetermined fraction is substantially 50%.

4. The combination defined in claim 1, 2 or 3 wherein said maximum period is substantially 15 seconds.

* * * * *